US005235817A

United States Patent [19]

Gallagher et al.

[11] Patent Number: 5,235,817

[45] Date of Patent: Aug. 17, 1993

[54] CRYOGENIC COOLING APPARATUS FOR RADIATION DETECTOR

[75] Inventors: Brian W. Gallagher, Highland Lakes, N.J.; Robert W. Bergensten, Middletown, N.Y.

[73] Assignee: North American Philips Corp., New York, N.Y.

[21] Appl. No.: 862,050

[22] Filed: Apr. 2, 1992

[51] Int. Cl.[5] ..... F25B 19/00

[52] U.S. Cl. ..... 62/51.1; 62/50.7; 250/352

[58] Field of Search ..... 62/51.1, 50.7; 250/352

[56] References Cited

U.S. PATENT DOCUMENTS

| | | | |
|---|---|---|---|
| 3,732,421 | 5/1973 | Kunimoto et al. | 250/83 |
| 3,864,570 | 2/1975 | Zingaro | 250/272 |
| 4,694,175 | 9/1987 | Buller | 62/51.1 |
| 4,910,399 | 3/1990 | Taira et al. | 250/310 |
| 4,931,650 | 6/1990 | Lowe et al. | 62/51.1 |
| 5,077,979 | 1/1992 | Skertic et al. | 62/51.2 |

FOREIGN PATENT DOCUMENTS 2192091 12/1987 United Kingdom .

*Primary Examiner*—Ronald C. Capossela
*Attorney, Agent, or Firm*—William L. Botjer

[57] ABSTRACT

Parallel heat paths are provided by three nested tubes, the outer tube being of stainless steel and connected cantilevered to a housing at ambient temperature. The innermost tube forms a cold finger having a negligible temperature gradient and secured in thermal conductive isolation concentrically within an intermediate cold sleeve tube which is also concentric within the outer tube, the cold finger and cold sleeve tubes being made of copper. The tubes have a minimum diameter and specular facing surfaces to minimize radiation coupling which is the major source of heat transfer between the tubes. The two inner tubes have minimum thermal conductive coupling via thermal insulating tapered rings at one end and a thermal insulating support at the other end. A radiation detector is secured to the inner cold finger tube for receiving X-ray radiation from a specimen in an electron microscope. The other ends of the two inner tubes ar thermally conductively connected to a heat sink Dewar via braided copper straps.

23 Claims, 4 Drawing Sheets

CRYOGENIC COOLING APPARATUS FOR RADIATION DETECTOR

FIELD OF THE INVENTION

This invention relates to apparatus for cryogenic cooling radiation detectors, more particularly, for cooling radiation detectors which may be used for detecting X-ray radiation in an X-ray microscopic spectroscopic system.

Of interest is commonly owned copending application Ser. No. 07/862,084 filed Apr. 2, 1992 entitled "Deicing Device for Cryogenically Cooled Radiation Detector" filed concurrently herewith in the name of the present inventors.

BACKGROUND OF THE INVENTION

Cryogenic cooling apparatuses for cooling radiation detectors to cryogenic temperatures are well known and widely used. In certain implementations, such a radiation detector is employed with an electron microscope for detecting X-rays incident on a specimen being spectroscopically examined. The specimen is placed within the microscope and receives incident X-ray radiation from the microscope. The scattered radiation from the specimen is then detected by a cryogenically cooled detector which converts the radiation to an electrical signal in a known way for spectroscopic analysis. The detector is mounted on an elongated structure referred to in the art as a cold finger. The finger is cantilevered to a support so as to be placed within the region of the electron microscope adjacent to the specimen. The interior of the microscope and the region surrounding the cold finger are within an evacuated chamber. Cooling of the detector is accomplished by the finger which is thermally conductively connected to a source of cryogenic cooling, for example, a Dewar containing liquid nitrogen.

U.S. Pat. No. 4,910,399 discloses an electron microscope with an X-ray detector in an arrangement as described above. U.S. Pat. No. 3,864,570 also disclose an X-ray detector for use with an electron beam producing device disclosing a cold finger structure. British Patent 2,192,091 discloses a still further embodiment of an electron microscope and X-ray detector system of the type described.

Typically in these kinds of systems, it is to reduce heat input to the cold finger mounting the X-ray detector by using low emissivity warm surfaces and by wrapping the cold finger with low emissivity aluminized mylar. One hundred percent of the heat input to the system is radiated to the mylar and then conducted to the cold finger or conducted through the supports directly to the cold finger. The cold finger conducts 100% of the heat input along its length to the heat sink comprising the Dewar. This results in a large difference in temperature between the heat sink and the end of the cold finger supporting the detector and results in an undesirable high detector temperature. Additionally, the mylar and other organic compounds used in the insulation system in the evacuated chamber in which the cold finger is secured evolve contaminants undesirable when used in a UHV environment.

SUMMARY OF THE INVENTION

A radiation detector cryogenic cooling apparatus in accordance with the present invention comprises a plurality of nested space thermally conductive elongated members having first and second ends. A first member is positioned external the other members. A second member is positioned intermediate the members and a third member is positioned innermost. Means secure the members in such thermal conductive and radiation relation such that among the members, the first member is closest to ambient temperature and the third member is the coldest with a negligible temperature gradient therein. Means thermally conductively couple the first end of the second and third members to a source of cryogenic cooling. Means secure a radiation detector to the third member at the second end distal the first end for cooling the detector to a cryogenic temperature. Because there is a relatively negligible temperature gradient in the coldest third member securing the detector, the detector is reliably maintained at the desired cryogenic temperature.

A feature of the invention is minimizing radiation coupling between the members by providing the members with specular surfaces facing one another to minimize their emissivity. Further, the support means for the members minimize thermal conductive coupling of the members by providing an insulating support which preferably provides edge contact to each of the members which in a preferred embodiment are tubular. The innermost tube members are copper and the outermost member is stainless steel.

Support means are provided for securing the members in a particular embodiment in spaced relation in which the support means include means for permitting the second and third members at one end to independently displace axially along the length of the members relative to one another and relative to the first member to allow for differences in thermal expansion of the members.

DESCRIPTION OF THE PREFERRED EMBODIMENT

Figures 1, 3:
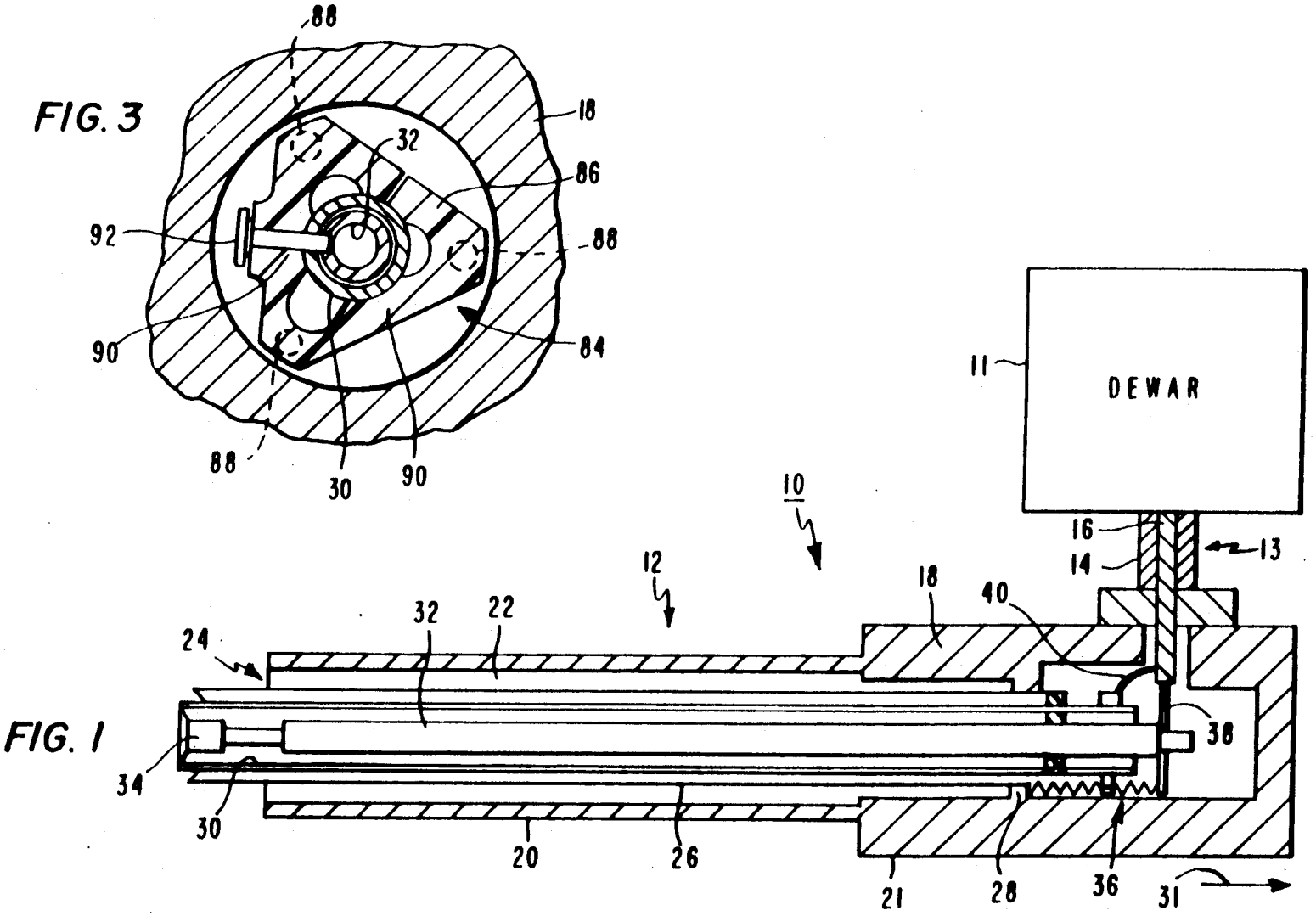
FIG. 1 is a side elevation diagrammatic partially sectional view of an apparatus in accordance with one embodiment of the present invention.
FIG. 3 is a sectional end view taken along lines 3–3 of FIG. 2.

In FIG. 1, cryogenic cooling system 10 comprises a Dewar 11 and a cold finger assembly 12 secured to the Dewar 11 via coupling structure 13. The coupling structure 13 includes a support 14 containing an aluminum heat conductor 16 which thermally conductively couples liquid nitrogen (not shown) contained in the Dewar to the assembly 12 to be cooled. The assembly 12 includes a housing 18 secured to the support 14. The housing 18 comprises an elongated fingerlike portion 20 extending from body 21. The housing 18 has an elongated cavity 22. Secured within the cavity 22 is a cooling finger assembly 24.

The cooling assembly 24 comprises an outer circular cylindrical stainless steel tube 26 secured to housing 18 by support 28. The tube 26 is referred to more generally as a warm cap because it is the warmest element of the finger assembly 24 and is thermally conductively coupled to the housing 18 via thermally conductive support 28. Concentrically secured within the warm cap tube 26 is a cold sleeve tube 30. Tube 30 is preferably made of copper and is secured at one end to the warm cap tube 26 and at its other end to housing 18 via a thermal insulator. Concentrically mounted within the cold sleeve tube 30 is cold finger 32. Tube 32 is preferably made of copper and is supported concentrically within and to tube 30 at its opposing ends. A radiation detector assembly 34 is thermally conductively secured to the end of tube 32 extending from the housing 18 for detecting X-ray radiation emitted by a microscope to be described below. A spring assembly 36 at the end of the finger assembly 24 opposite detector assembly 34 resiliently urges the tubes 30 and 32 in direction 31 in engagement with the warm cap tube 26 which is fixed to housing 18. The aluminum heat conductor 16 from the Dewar 11 thermally conducts heat from the cold finger 32 via a copper strap 38 and heat from the cold sleeve tube 30 via a copper strap 40. Straps 38 and 40 preferably are braided copper with a lead tin coating to permit soldering to the cold finger 32 and cold sleeve tube 30 and to conductor 16. The tubes 26 and 30 and finger 32 provide parallel heat conductor paths to housing 18 and Dewar 11 as will be explained in more detail below.

Figure 2:
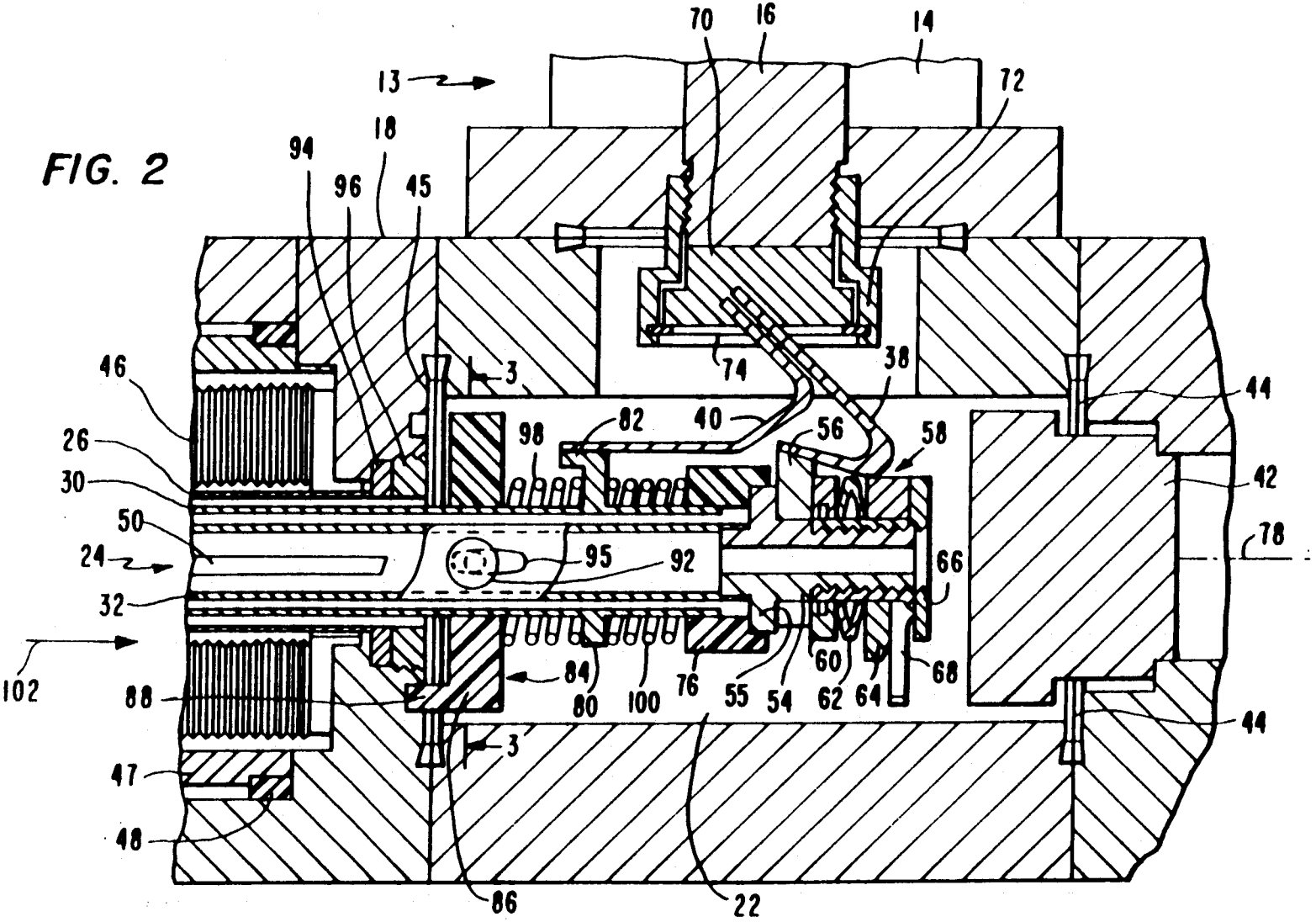
FIG. 2 is a more detailed side elevation sectional view of one end of the apparatus cold finger structure illustrated in FIG. 1 closest to the Dewar.

FIG. 2 shows in more detail the supporting structure for securing the cooling finger assembly 24 to the housing 18 In FIG. 2, the relative dimensions of the cold finger assembly 24 are not to scale for purposes of illustration. The housing 18 comprises a number of different elements not part or the present invention. For example, the housing 18 includes a radiation shield 42 secured to the housing 18 via a copper gasket 44. This also permits the cavity 22 to be sealed from the ambient atmosphere to permit a vacuum to be provided to cavity 22 to a pressure of less than $1\times10^{-7}$ Torr. The cavity 22 along the length of the cooling assembly 24 is evacuated to this low pressure. A bellows 46 couples the vacuum from the front portion of the cavity 22 adjacent to the detector support assembly 34 (FIG. 1) to the region adjacent to Dewar 11. Housing 18 also includes a telescoping assembly 47, not shown in detail, mounted on a bearing 48 and sealed via gasket 45 to other parts of the housing. Only a portion of assembly 47 is shown. This permits the detector assembly 34, FIG. 1, to be telescoped toward and away from the location of the Dewar 11. The detailed construction of the telescopic assembly 47 is also not part of the present invention. What is important is that all of the housing 18 elements form a vacuum tight seal relative to cavity 22.

Secured within the elongated hollow core of cold finger 32 is wire harness 50 for coupling the electronics associated with the detector assembly 34 to external circuitry (not shown). Cold finger 32 is a circular cylindrical copper tube which is preferably about 0.375 inches (9.25 mm) in outside diameter and is at a temperature of 87° K with about a 1° K temperature gradient from end to end. Finger 32 has a polished external surface that has a specular finish to provide a relatively low emissivity factor, for example, around 0.1. This low emissivity minimizes radiation coupling of the cold finger 32 to the cold sleeve tube 30 which radiation coupling is the major source of heat transfer. The cold finger 32 is soldered to a copper sleeve 54 having a annular flange 55. A copper annular lug 56 is clamped to flange 55 by clamp assembly 58. Assembly 58 includes a clamp 60 which is resiliently forced against lug 56, squeezing lug 56 and locking it against flange 55 via spring 62. A lever locking mechanism 64 is secured to sleeve 66 for releasably locking the clamp assembly 58 to sleeve 66 via an eccentrically secured locking lever 68. The clamp assembly 58 is threaded to the sleeve 54. The lever locking mechanism 64 locks the clamp assembly 58 in a given axial position along the flange member 54 to lock the spring 62 in compressive engagement against the clamp 60. This action locks the copper lug 56 in place. The lug 56, sleeve 54, washer 52 and cold finger 32, all being made of copper, are relatively good thermal conductors. Strap 38 is soldered at one end to the lug 56 to provide thermal conductive relation between the lug 56 and, thus, the cold finger 32 to the aluminum heat conductor 16.

A stepped copper disc 70 is thermally conductively connected to heat conductor 16 via a stainless steel clamp 72 and retainer ring 74. The clamp 72 is threaded to the heat conductor 16 such that the disc 70 is in good thermal conductive contact with the conductor 16. The strap 38 is thermally conductively connected to and soldered to the disc in a slot thereof. As a result, the heat path from the cold finger 32 is coupled to the conductor 16 via sleeve 54, lug 56 and strap 38.

A thermally insulating annular ring 76 has a stepped shoulder in axial and radial engagement with flange 55 as shown. Ring 76 is preferably made of a material referred to as Kel-f. This material is a fluorocarbon plastic commercially available as polychlorotrifluoroethylene or PCTFE which is a thermal and electrical insulator. The Kel-f material also has the characteristic in that it has minimum moisture absorption which is a desirable characteristic in an evacuated atmosphere of the cavity 22. All of the thermal conductive insulators in the cold finger assembly to be described are made of PCTFE material. This material has good machinability, high strength and is a good thermal conductive insulator.

The cold sleeve tube 30 end in the housing 18 is slidably closely received within ring 76 so that the tube 30 may slide axially along axis 78 relative to ring 76. The tubes 26 and 30 and cold finger 32 are concentric about axis 78. Tube 30 includes an annular ridge 80 extending about the external periphery of the tube 30. Extending radially outwardly from ridge 80 is a lug 82 which is integral with the tube 30 via ridge 80 and to which strap 40 is soldered. The other end of strap 40 is preferably thermally conductively connected to disc 70 by soldering. In this embodiment, strap 40 thermally conductively connects tube 30 to the heat sink conductor 16. However, in other implementations, this direct conductive connection to heat sink conductor 16 may be replaced by radiation coupling.

A tube support assembly 84 made of PCTFE secures the tube 30 in the radial direction to the housing 18. The tube support assembly 84 includes a central triangular support 86 from which axially extend three spaced prongs 88. The prongs 88 are spaced 120° apart about axis 78 and engage a mating recess in the housing 18 for securing the tube 30 in relative fixed radial and rotational relation to the housing 18 about axis 78.

In FIG. 3, the support 86 is of equilateral triangular shape with each of the prongs 88 attached adjacent to a different truncated apex of the triangle. Support 86 also has 120° spaced apart support regions 90 which engage the tube 30 peripheral surface. A locking pin 92 engages the member 86 and passes through a mating slot 95 (FIG. 2) in the tube 30 and cold finger 32. The pin 92 prevents rotation of the finger 32 and tube 30 relative to the housing 18 about axis 78. This is so as to permit the probes 88 to rotationally lock the support 86, the tubes 30 and cold finger 32 to the housing 18.

In FIG. 2, the warm cap tube 26 has an annular flange 94. Flange 94 is locked to the housing 18 by a locking ring 96 which is threaded to the housing 18. The flange 94 is stainless steel and is integral with the warm cap tube 26. The tube 26 is in thermal heat conductive relation with the housing 18 and generally is at the temperature of the housing 18 at the flange 94. The warm cap as mentioned previously is stainless steel to provide a relatively higher thermal conductive resistance for heat flow as compared to the copper cold sleeve tube and copper cold finger. Tube 26 therefore serves as a relative insulator. The tubes and finger are in relatively close spaced relationship to minimize surface areas that are exposed to one another to minimize radiation coupling, which coupling is a function of the magnitude of the exposed relatively warm surface area. The facing surfaces of the warm cap tube 26, the cold sleeve tube 30 and cold finger 32 are all highly polished specular surfaces to provide low emissivity, for example, an emissivity factor of about 0.1, to minimize radiation coupling. By way of example, the warm cap 26 may have an 0.625 inch (15.9 mm) outside diameter and an 0.585 inch (14.9 mm) inside diameter whereas the cold sleeve tube 30 may have an 0.535 inch (13.6 mm) outside diameter, and an 0.035 inch (0.9 mm) wall thickness. Therefore, there is about an 0.025 inch (0.6 mm) spacing between the facing surfaces of the warm cap tube 26 and the cold sleeve 30. There is about an 0.0625 inch (15.9 mm) spacing between the outer surface of the cold finger 32 and the inner facing surface of the cold sleeve tube 30.

An annular compression spring 98 is secured about tube 30 between ridge 80 and support assembly 84. A second compression spring 100 is secured between ridge 80 and ring 76 also about tube 30. The spring 98 resiliently couples tube 30 in the axial direction to housing 18 forcing tube 30 in direction 102. Spring 100 resiliently couples tube 30 in the axial direction to cold finger 32. Spring 100 forces tube 32 also in the direction of arrow 102. Further, springs 98 and 100 permit the tube 30 and cold finger 32 to float in the axial direction for axial displacement in response to thermal expansion and contraction of the tubes in response to temperature cycling such as for example when the structures are at ambient temperature as compared to being at cryogenic temperatures. To permit this action, the pin 92, passes through the slot 95 in both tube 30 and cold finger 32. Thus, the pin 92 permits the tubes to move axially relative to one another and to housing 18 while at the same time preventing tube rotational displacement about axis 78. The warm cap tube 26 is at the warmest temperature and the cold finger and the cold sleeve tube 30 at the end of the cold finger assembly in FIG. 2 being coupled to the Dewar via straps 38 and 40 are relatively close in temperature, e.g., 87° K, at this location of the structures.

Figure 4:
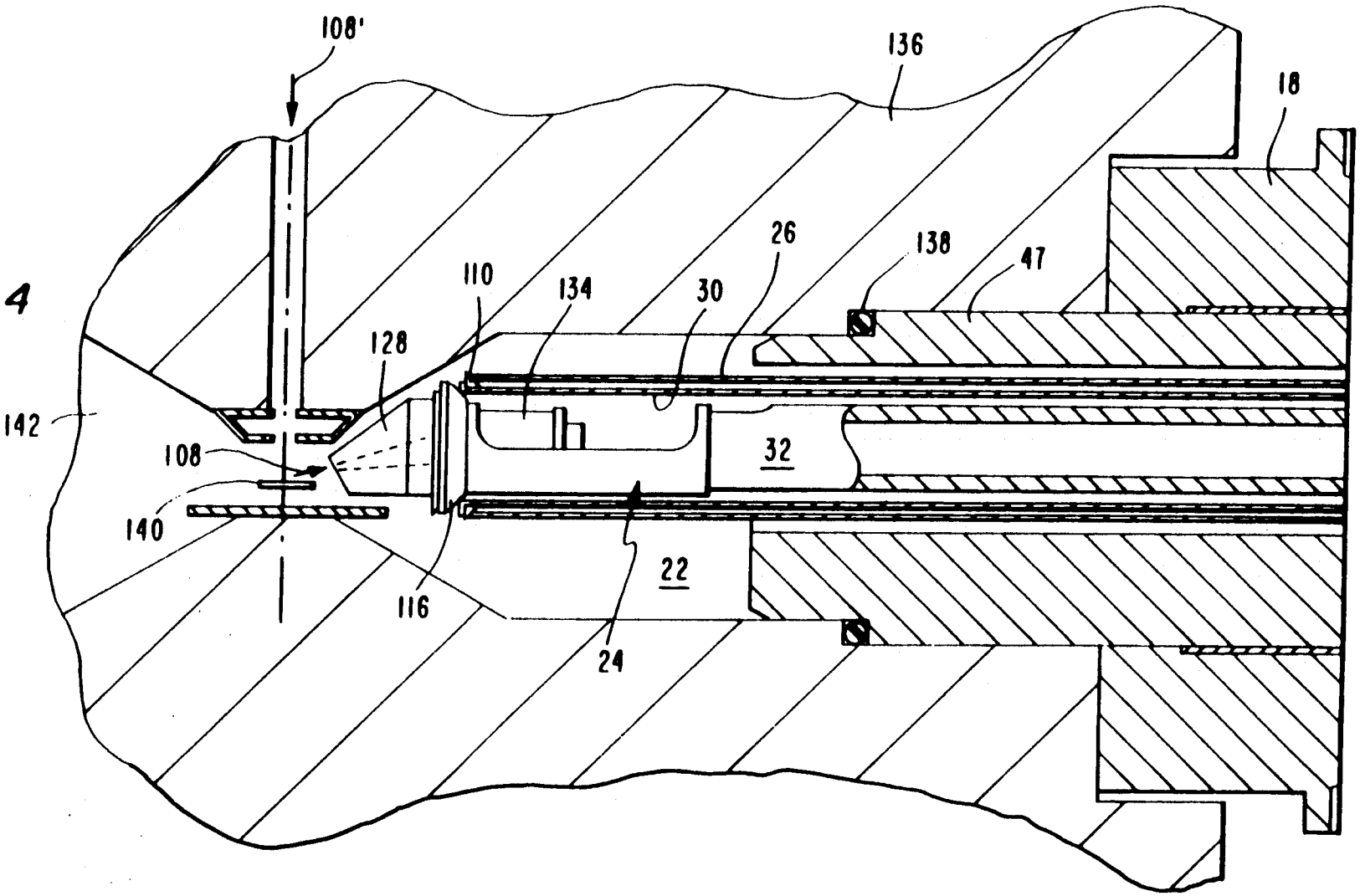
FIG. 4 is a more detailed sectional side elevation view of the end of the cold finger construction of FIG. 1 securing the detector and in engagement with an electron microscope structure.
Figure 5:
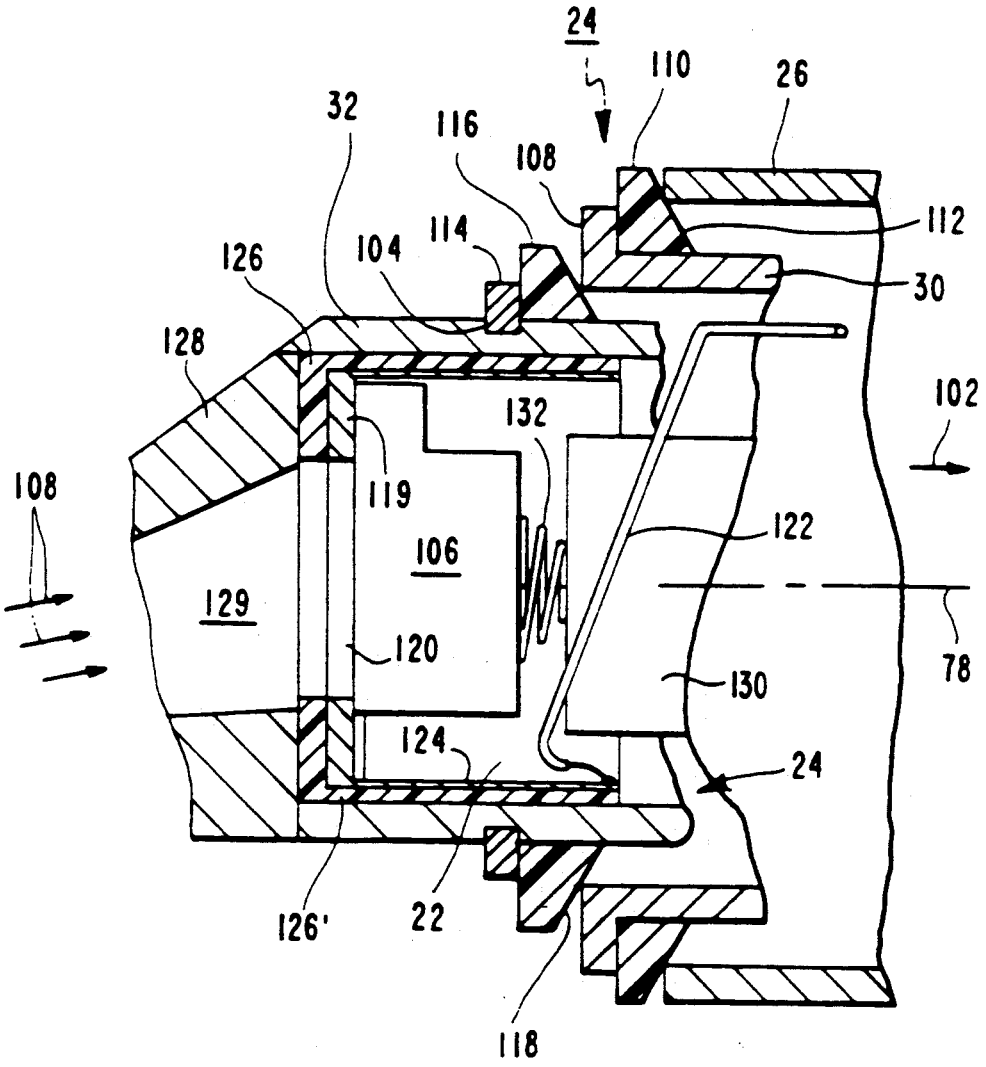
FIG. 5 is an enlarged sectional view similar to that of FIG. 4 illustrating the detector support structure.

In FIG. 5, the front end of the cooling finger assembly 24 is shown for supporting and cooling detector 106. Detector 106 is a silicon crystal which detects X-ray radiation 108 scattered from a specimen 140, FIG. 4, being examined. The tube 30 has at its end an annular flange 108. An annular washer 110 made of PCTFE is secured in abutting relation with flange 108 and the external peripheral surface of tube 30. The ring 110 has a tapered surface 112 facing the end of tube 26 and in edge contact with an end corner edge of tube 26. This annular edge contact of tube 26 with thermally conductive insulating ring 110 substantially thermally conductively isolates the tube 26 from the tube 30. Surface 112 by being tapered also maintains the spaced relation between the tubes 26 and 30 by precluding radial displacement of tube 26.

The ring 110 maintains the spaced relationship between tubes 26 and 30 by reason of the fact that tube 26 is fixed to the housing 18 as described above while the tube 30 is being pushed in the direction 102 as described previously. This locks the tube 30 to the tube 26 via the ring 110. An annular retaining ring 114 is secured in a mating annular groove 104 in the cold finger 32. An annular tapered ring 116 of PCTFE similar in construction to ring 110 is in abutting relation with the ring 114 and external surface of tube 32 as shown. The ring 116 has a tapered surface 118 which is in edge contact with a corner edge of tube 30 as shown. As described above since the spring 100 provides a force in direction 102 on finger 32, the finger 32 is locked against the tube 30 via the ring 116. The ring 116 also fixes the radial spacing relationship of the tube 30 relative to the finger 32 via the tapered surface 118. Further, the edge contact of the tube 30 with the ring 116 provides minimal thermal conductive path between the tube 30 and finger 32. All of the tubes 26 and 30 and finger 32 are cantilevered at this location.

A detector 106 is secured in ohmic contact with a metal washer 118 having an aperture 120 so that radiation 108 can impinge on the detector 106. The washer 118 provides an electrical contact from a bias signal conductor 122 to the washer 118 via conductor 124. The conductor 124 is a circular tubular sleeve that is ohmically connected to the washer 118. A similarly shaped PCTFE tubular member 126 has a mating washer-like portion 126' engaged with washer 118 tubular sleeve conductor 124.

The member portion 126' has a relatively thin tubular wall, e.g., 3 mils (0.08 mm) thick, between the cold finger 32 and the conductor 124. This is to permit significant thermal conductive coupling between the finger 32 and the washer 118 via the conductor 124. Further, the insulating washer portion of member 126 in engagement with washer 118 is also relatively thin, e.g., 10 mils (0.25 mm) thick, to permit thermal coupling between washer 119 and a collimator 128 soldered to the end of cold finger 32. Collimator 128 is made of copper and is thermally conductive connected to the cold finger 32 and at the same temperature as cold finger 32. The collimator 128 has a conical smooth walled aperture 129 through which radiation 108 passes. This structure is described in more detail in the aforementioned corresponding application incorporated by reference herein. Thus, a heat path is provided from collimator 128 to the washer 119 through the washer portion of member 126. The collimator 128, for example, is at 87° K while the detector 106 is at 92° K, a 5° C. temperature differential due to a heat input from the detector electronics, which heat input is acceptable. A field effect transistor FET 130 is secured to the cold finger 32. Compression spring 132 is between the FET 130 and the detector 106 forcing the detector 106 against washer 119 to provide both thermal and ohmic connection therebetween. The connections between 1) washer 119 and detector 106 and 2) FET 130 and detector 16 are both thermally and ohmically conductive.

In FIG. 4, the telescopic assembly 47 at its front most end adjacent to the detector assembly 134 is secured to the housing 18. Electron microscope 136 is secured to the telescoping assembly 47 and sealed thereto via an O-ring 138. A specimen 140 is held in the path of X-ray beam 108' so as to emit scattered radiation 108 toward the collimator 128 for detection by the detector 106 in assembly 134.

In operation of the system, the cavity 22, FIGS. 2 and 5, is evacuated at a relatively low pressure and coupled to the microscope cavity 142 as seen in FIG. 4. The microscope and system 10 therefore form a common system at an evacuated pressure.

In FIGS. 2 and 5, the cold finger assembly 24 comprising cold tube 32 is at the desired temperature of 87° K within 1° K between opposing ends at which the detector 106 is located and at which the strap 38 is coupled. The relatively constant temperature of the cold finger 32 is provided by the parallel heat paths of the cold sleeve tube 30 and the warm cap tube 26. The radiation coupling of the warm cap tube 26 to the cold sleeve 30 is the primary source of thermal coupling between the two tubes. There is relatively negligible heat conducted through the thermal conductive paths provided at the end structures between the two tubes. This thermal radiation is minimized by the specular surfaces and by minimizing the magnitude of the surface areas of the facing tubes 26 and 30. The close spacing of the two tubes is inconsequential with respect to the radiation coupling because the amount of surface area giving off the radiation provides the radiation significant thermal coupling of the two tubes. Cold sleeve tube 30 is warmest at its extended cantilevered end, FIG. 4, adjacent to the ring 110. Because the tube 26 is made of stainless steel it has a relatively higher thermal conductivity resistance than that of the copper tube 30 and the cold finger 32. The tube 26 serves effectively as a relative insulator with respect to the heat paths. Therefore a relatively lower amount of heat is conducted to the cantilevered end of tube 26. The cold sleeve tube 30, because it is radiation coupled to the tube 26, is at a relatively warm temperature as compared to that of the cold finger 32. For example, the tube 30 may be at 130°-140° kelvin at the detector end. However, a relatively large temperature gradient is exhibited by the tube 30 because its end coupled to the Dewar 11 in FIG. 1 via strap 40 is at the cryogenic temperature of approximately 87° kelvin because of the cooling effects of the conductor 16. Thus, most of the heat radiation coupled from the tube 26 to the tube 30 is conducted by tube 30 to the Dewar 11. Because of the radiation and thermal conductive isolation between the tube 30 and the cold finger 32 and because most of the heat in tube 30 is conducted to the Dewar 11, a relatively low temperature gradient is exhibited by the cold finger 32. The detector 106 operates more efficiently as it gets cooler and, therefore, providing the detector with the lowest possible temperature provides more efficient operation of the system.

The parallel path insulation system described passively diverts the majority of heat flow away from the finger directly to the heat sink provided by the Dewar 11. This reduces the amount of heat carried by the cold finger allowing colder temperatures further away from the heat sink. The heat radiated inwardly from the housing 18 surfaces is reduced by polishing these housing surfaces to the specular finish to reduce their emissivity. Since the amount of heat transfer is by radiation, it does not increase as a function o distance between the warming cold surfaces, but rather decreases dramatically with reduction in warm surface area further minimizing the radiation coupling. The supporting structure for the cold sleeve tube 30 and the cold finger 32 minimize conducted heat input and insures that minimum heat is primarily conducted directly to the cold sleeve.

Greater than 98% of the heat input to the system is radiated or conducted directly into the cold sleeve tube 30. More than 90% of the heat in the cold sleeve tube 30 is diverted along its length to the heat sink. This occurs because the conductive thermal resistance through the cold sleeve tube is significantly lower than the radiative thermal resistance to the cold finger. The conductive thermal resistance in the cold sleeve tube 30 is controlled by the conductivity of the material, the difference in temperature along the length of the cold sleeve tube and by the ratio of the cold sleeves cross-sectional area and length. The radiative thermal resistance of the cold finger is determined by the warm surface area of the warm cap tube 26, the difference in temperatures between the respective facing surfaces of the warm cap, cold sleeve and cold finger, the emissivity of the cold sleeve inside and outside diameters and, to a lesser degree, the emissivity of the cold finger outside diameter. The result of this construction is that less heat reaches the center cold finger 32 than otherwise would be possible. The total heat that is transferred to the cold finger 32 is less than 12% of the total heat input into the system and is conducted along the length of the cold finger to the heat sink of the heat conductor 16. Because of the reduction in heat carried by the cold finger, the detector 106 and its electronics can be operated at a lower temperature for a given ratio of cold finger 32 length to the housing 18 diameter. This allows for efficient cooling and increase in distances from the heat sink conductor 16 with a small diameter housing. These kind of advantages typically are available only with heat pipes.

The simplicity of the elements allows for inexpensive fabrication and assembly not typically available even with heat pipes. Also, the reduction of volatile inorganic materials in the system allows for compatibility with UHV environments. While a particular implementation has been described in connection with radiation detection in a electron microscope, the principles of the present invention are applicable to any insulation system, whether insulating from heat or cold, or in any kind of fluids in any kind of temperature ranges using materials of concentric shapes of any size or number for transferring heat in parallel paths for the purpose of controlling the temperature of a given device.

What is claimed is:

1. A radiation detector cryogenic cooling apparatus comprising:

first, second and third thermally conductive tubular members secured in nested concentric spaced relation, said first member being external and the third member being positioned innermost in said spaced relation;

means for securing the first member in substantial thermal conductive isolation relative to the other members;

means for coupling one end of the second and third members to a source of cryogenic cooling; and means for securing a radiation detector to the third member at the other end opposite the one end, said first member exhibiting the highest temperature and the third member exhibiting the lowest temperature and a negligible temperature gradient between said one and other ends.

2. The apparatus of claim 1 wherein said members have an emissivity value such as to minimize radiation coupling between the members.

3. The apparatus of claim 1 wherein said first member is stainless steel and the second and third members are copper, each member having a specularly reflective surface facing the other member.

4. The apparatus of claim 1 wherein said means for securing includes coupling means at said other end for securing said other end of the members to each other.

5. The apparatus of claim 4 wherein said coupling members are made of thermal insulating material.

6. The apparatus of claim 4 wherein said coupling means at said other end includes a first coupling member secured to the third member and having an annular tapered surface facing and in edge contact with the other end of the second tubular member and an annular second coupling member secured to the second member at said other end, said second coupling member having a tapered surface in edge contact with the other end of the first member.

7. The apparatus of claim 6 including means secured to the first member for resiliently urging the second and third members in said edge contact.

8. The apparatus of claim 1 including support means for securing the each said members in said spaced relation, said support means including means for permitting the second and third members at said one end to independently displace axially along the length of said members relative to one another and relative to the first member.

9. The apparatus of claim 1 including support means for securing each said members in said spaced relation, said support means including means for securing the members so as t preclude relative rotation of tee members to one another.

10. The apparatus of claim 1 including an electrical conductor secured within and to said other said third member other end adapted for ohmically engaging said detector, and electrical insulation means secured to said third member other end for electrically isolating said other third member end from said conductor and constructed such that said detector is approximately at the temperature of said third member at said other end.

11. The apparatus of claim 1 including support means for supporting said members approximately at their ends.

12. A radiation detector cryogenic cooling apparatus for an electron microscope comprising:

a housing adapted to be secured to said electron microscope;

first, second and third thermally conductive elongated members secured in nested spaced relation, said first member being positioned external and the third member being positioned innermost in said spaced relation;

means for securing the first member to the housing in substantial thermal conductive isolation from the other members;

means for coupling the second and third members at a given location thereon to a source of cryogenic cooling; and means for securing a radiation detector to the third member at a region distal said given location, said members being arranged such that the third member exhibits a negligible temperature gradient between said given location and said region, said detector being positioned so as to receive radiation from said microscope when coupled to said microscope.

13. A radiation detector cryogenic cooling apparatus comprising:

a plurality of nested spaced thermally conductive elongated members having first and second ends, a first member being positioned external the other members, a second member being positioned intermediate said members and a third member being positioned innermost;

means for securing the members in such thermal insulation and radiation relation such that among the members, the first member is closest to ambient temperature and the third member is the coldest with a negligible temperature gradient therein, at least said third member including means a one end thereof adapted to be thermally coupled to a source of cooling; and means for securing a radiation detector to the third member at the second end distal said first end for cooling the detector to said coldest temperature.

14. The apparatus of claim 13 wherein the second and third members have the same given thermal conductivity, said first member having a thermal conductivity less than that of the second and third members, said first member being at ambient temperature.

15. The apparatus of claim 14 wherein the members are circular metal tubes.

16. The apparatus of claim 14 including a support, said first member being secured cantilevered from the support at its first end closest to the first ends of the second and third members, the second and third members being secured at their second ends opposite the first ends to the first member in substantially thermally conductive isolation relative to each other and to said first member, said second and third members being secured to the support approximately at said first ends in substantially thermally conductive isolation relative to each other and to said support.

17. The apparatus of claim 16 wherein the members have an axis along an elongated dimension thereof, said apparatus including means secured to said second and third members for permitting axial displacement of the second member relative to the third member in response to difference in thermal expansion and contraction of the second and third members.

18. The apparatus of claim 13 wherein the members have specular surfaces facing one another.

19. The apparatus of claim 13 including means for resiliently urging the first ends of the second and third members toward their second ends.

20. The apparatus of claim 19 including support means for said second and third members arranged to provide thermally conductive isolation edge contact of the first member to the second member and of the second member to the third member at said second ends.

21. The apparatus of claim 13 further including an electron microscope which emits X-ray radiation, said detector comprising means responsive to said emitted X-ray radiation secured to the third member at said second end, said apparatus including a housing to which said first member is secured in cantilevered relation adjacent to its first end, said housing being secured to the microscope so that said detector is in position to receive said emitted X-ray radiation.

22. The apparatus of claim 21 wherein said housing and microscope are adapted to provide an evacuated chamber containing said first, second and third members.

23. A cryogenic cooling apparatus for cooling a radiation detector for use with an electron microscope comprising:

a housing adapted to be secured to said microscope;

a thermally conductive elongated tubular cold finger in said housing and having first and second ends;

a radiation detector secured to the finger second end;

first and second thermally conductive tubes arranged in nested spaced concentric relation with each other and said cold finger;

means for securing the ends of the cold finger to corresponding adjacent ends of the second tube next adjacent to the cold finger in thermally conductively insulating relation;

means for securing the ends of the second tube to corresponding adjacent ends of the first tube surrounding the second tube in thermally conductively insulating relation;

means for securing the first tube to the housing at an end adjacent to said finger first end; and means for thermally conductively coupling a cryogenic cooler to at least said finger at said finger first end.

* * * * *